US005311934A

United States Patent [19]

Potier

[11] Patent Number: 5,311,934

[45] Date of Patent: May 17, 1994

[54] HEAT EXCHANGER OF THE TYPE COMPRISING A FINNED TUBE BUNDLE AND A HEADER COMPRISING A HEADER PLATE AND A HEADER CASING

[75] Inventor: Michel Potier, Rambouillet, France

[73] Assignee: Valeo Thermique Moteur, Le Mesnil-St. Denis, France

[21] Appl. No.: 50,541

[22] Filed: Apr. 20, 1993

[30] Foreign Application Priority Data

Apr. 21, 1992 [FR] France ..... 92 04860

[51] Int. Cl.[5] ..... F28F 9/02

[52] U.S. Cl. ..... 165/149; 165/173

[58] Field of Search ..... 165/78, 149, 173

[56] References Cited

U.S. PATENT DOCUMENTS 4,705,104 11/1987 Potier ..... 165/149

FOREIGN PATENT DOCUMENTS 2048451 12/1980 United Kingdom ..... F28F 9/02

2086561 5/1992 United Kingdom ..... F28F 9/04

*Primary Examiner*—Allen J. Flanigan

*Attorney, Agent, or Firm*—Morgan & Finnegan

[57] ABSTRACT

A heat exchanger, especially a motor vehicle radiator, comprises a bundle of finned tubes open into a header consisting of a header casing and a header plate. The ends of the tubes in the bundle are sealingly fitted in holes in the header plate, and at least one immobilizing element passes through the header plate and extends beyond the latter on the same side as the tubes, and in a direction parallel to the longitudinal direction of the tubes. The immobilizing element is abutted on a part of the tube bundle, in such a way as to oppose any relative displacement, in particular by pivoting or torsion of the tube bundle with respect to the header plate.

7 Claims, 1 Drawing Sheet

HEAT EXCHANGER OF THE TYPE COMPRISING A FINNED TUBE BUNDLE AND A HEADER COMPRISING A HEADER PLATE AND A HEADER CASING

FIELD OF THE INVENTION

This invention relates to heat exchangers, in particular radiators for use in motor vehicles, of the type comprising a bundle of finned tubes and at least one header comprising a header plate and a header casing, the tubes being fitted in the header plate.

BACKGROUND OF THE INVENTION

It is known from the specification of French published patent application FR2560368A to provide a heat exchanger of the above type in which the end portions of the tubes are sealingly mounted in holes formed in the header plate, on which the header casing is secured, and in which immobilising or locating means are provided for the purpose of opposing any relative displacement, in particular by pivoting or torsion, of the tube bundle with respect to the header plate. In heat exchangers of this known type, sealing between the end portions of the tubes and the edges of the holes formed through the header plate is generally obtained by means of an elastomeric or similar gasket, which overlies one face of the header plate and which is formed with collar portions engaged in the holes in the header plate, between the end portions of the tubes and the edges of these holes.

In the particular type of heat exchanger disclosed in the above mentioned French patent specification, the said immobilising means provide a rigid coupling between the bundle of tubes and the header itself. This coupling thus resists any relative movements of the bundle of tubes with respect to the header plate, which may be liable to occur when the heat exchanger is handled either before or during its fitting on a vehicle, or even after it is installed in the vehicle. Such relative movements, which are detrimental to sealing between the ends of the tubes and the edges of the holes through the header plate, tend to occur most often in the case where the tube bundle consists of a single row of aligned tubes.

Again in the heat exchanger described in the above mentioned French patent specification, the immobilising means include lugs which are engaged in slots formed in the edges of the fins of the tube bundle, or alternatively fingers which are engaged in aligned openings formed in the fins. This arrangement therefore has the disadvantage that it is necessary to provide fins of a particular or special form, so that standard fins cannot be used.

DISCUSSION OF THE INVENTION

A particular object of the invention is to overcome these drawbacks.

To this end, the invention provides a heat exchanger of the type comprising a bundle of tubes having fins, in which the end portions of the tubes are sealingly mounted in holes in a header plate on which a header casing is fixed, and in which immobilising means are provided for the purpose of opposing any relative displacement, in particular by pivoting or torsion, of the tube bundle with respect to the header plate, characterised in that it includes at least one immobilising element which extends through the header plate and beyond the latter, in a direction parallel to the longitudinal direction of the tubes, and in that the or each immobilising element passes sealingly through an aperture formed in the header plate, and includes an extension which is abutted against the longitudinal sides of a group of several fins situated adjacent to the header plate.

In this way, the heat exchanger of the invention can be made using fins of a standard type, that is to say fins which are not provided with slots or openings as was the case in the prior arrangement described above.

In this case, the abutment takes place on the edges of the tube bundle defined by the longitudinal edges of the fins, and this makes it unnecessary to provide the slots mentioned above.

In a first embodiment of the present invention, each immobilising element includes a retaining head which is adapted to engage in a dished or countersunk element surrounding an aperture in the collector, this head being attached to the above mentioned extension of the immobilising element. These immobilising elements in this embodiment are independent components which are introduced through appropriate apertures formed in the header plate, so that their respective extensions abut on the longitudinal edges of the above mentioned group of fins.

In the case where the heat exchanger includes a sealing gasket, of elastomer or similar material, overlying the header plate, the invention preferably provides that this gasket also overlies the respective heads of the immobilising elements. In this way, sealing is guaranteed at the apertures formed through the header plate and through which the immobilising elements pass.

In this version the heat exchanger preferably also includes abutment elements depending from the header casing, with each of these abutment elements abutting against the head of an immobilising element, so as to prevent any retraction of the latter from the corresponding aperture. Thus the abutment members prevent any accidental shifting of the immobilising elements.

In another embodiment of the invention, each immobilising element depends from the header casing and is formed integrally with it. In the case where the heat exchanger includes a sealing gasket, of elastomer or similar material, overlying the header plate, each immobilising element then extends sealingly through this gasket.

In one or other of the two versions, mentioned above, of heat exchangers according to the invention, the said extension of each immobilising element preferably includes a flat which defines a retaining shoulder for engagement against the associated group of fins. In this way, an appropriate spacing is guaranteed between the first fin of the tube bundle and the header plate.

The description of preferred embodiments of the invention which is given below is by way of example only and with reference to the accompanying drawings.

DESCRIPTION OF PREFERRED EMBODIMENTS OF THE INVENTION

Figure 1:
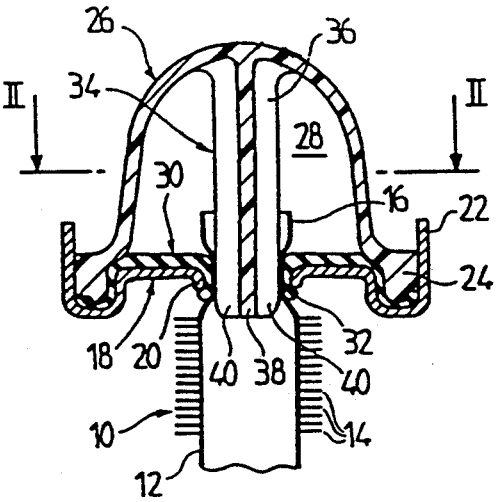
FIG. 1 is a view in transverse cross section of part of a heat exchanger in a first embodiment of the invention.

The heat exchanger shown in FIG. 1 comprises a bundle 10 consisting of a single row of aligned tubes, having flat fins 14 parallel to each other and extending at right angles to the longitudinal direction of the tubes 12. Each tube 12 has an end portion 16 which is sealingly fitted in a hole, which is circular in this example and which is formed through a header plate 18, otherwise referred to as a perforated plate or collector. Each of the holes in the header plate has an upset edge 20 defining a collar portion and projecting towards the fins 14 of the tube bundle.

The header plate 16 has peripheral gripping lugs 22, which are arranged to be upset over a peripheral flange 24 of generally rectangular shape, which is part of a header casing 26. The header casing 26 and the header plate 18 together constitute a water header of the heat exchanger. The interior of this header is a header space 28 delimited by the casing 26 and plate 18 and communicating with the tubes 12. Sealing around the end portion 16 of the tubes 12 is obtained by means of an elastomeric gasket 30 which overlies one face of the header plate 18 and which is formed with collar portions 36 which are gripped between the edges 20 of the holes in the header plate and the end portions 16 of the tubes 12.

To the extent thus far described, the structure of the heat exchanger is of a known type, which commonly also includes a further, similar, header at the other end of the tube bundle.

A heat exchanger of this kind, because it includes a single range of aligned tubes 12, may undergo relative movements of the tube bundle 10 with respect to the header plate 18, either by torsion or by pivoting, before or during its fitting in a vehicle, or after it has been installed. Similarly, the collar portions 32 of the gasket 30 may be deformed between the end portions 16 of the tubes and the edges 20 of the holes in the header plate, and this can give rise to rupture of the collar portions 30, with consequent danger of leakage. The invention provides a way of overcoming this disadvantage by providing immobilising or locating means which are adapted to give a rigid connection between the tube bundle 10 and the header 18, 26, without any need to provide fins 14 of a special construction.

In the embodiment shown in FIG. 1, the heat exchanger comprises at least one immobilising element 34, in the form of a post which depends from the header casing, with which it is formed integrally by moulding in a suitable plastics material. The post 18 extends in a direction parallel to the longitudinal direction of the tubes 12, and has an end portion 36 which is attached to the base of the header casing 26. The opposite, free, end 38 of the post is introduced into the end portion 16 of a corresponding one of the tubes 12. The end portion 38 of the post extends far enough into the end portion 16 of the tube to pass through the collector plate 18 and to project beyond the latter.

Figure 2:
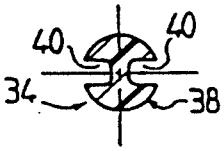
FIG. 2 is a view in cross section taken on the line II—II in FIG. 1.

As shown in FIG. 2, the immobilising element 34 in the form of a post has a right circular cross section, the outer diameter of which corresponds to the inner diameter of the end portion 16 of the corresponding tube 12, so that it can fit within the latter. The element 34 has a constant cross sectional shape, and it is provided with two diametrically opposed grooves 40 extending longitudinally, i.e. parallel to the axis of the post 34. Thus, after the header plate has been fitted, the end portion 38 of one post 34, rigidly engaged in the end of the tube, prevents any relative displacement of the tube bundle 10 with respect to the header 26, 18. In addition, the grooves 40 define two peripheral passages which enable fluid to flow between the corresponding tube 12 and the header space 28.

The heat exchanger preferably includes at least two of the elements 34, these being formed by moulding integrally with the header casing 26, and cooperating with two of the tubes 12 by means of their respective end portions 38. In this connection it is not necessary to provide the same number of immobilising elements 34 as there are tubes in the bundle 10.

Figure 3:
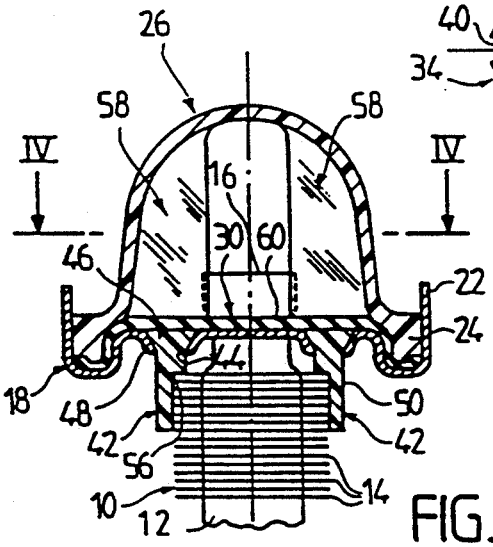
FIG. 3 is a view in transverse cross section taken from the line III—III in FIG. 4, showing part of a heat exchanger in a second embodiment of the invention.
Figure 4:
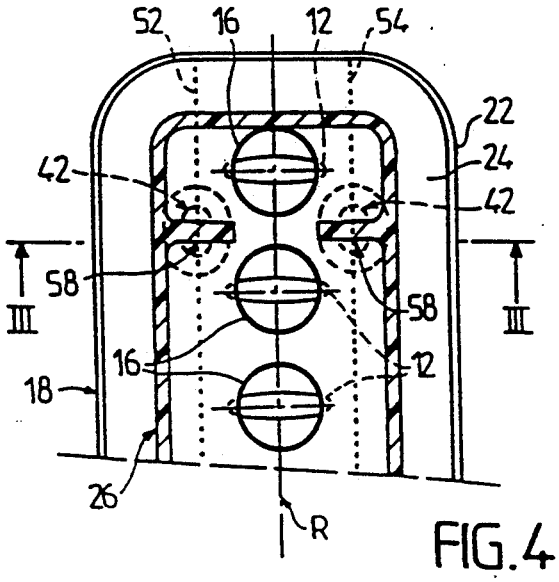
FIG. 4 is a view in cross section taken on the line IV—IV in FIG. 3, again showing part of the same heat exchanger.

In the embodiment shown in FIGS. 3 and 4, to which reference is now made, the heat exchanger includes the immobilising elements 42 in the form of pegs or pins, each of which passes sealingly through an aperture 44 formed in the header plate 18. Each of the elements 42 includes a retaining head 46 which engages in a countersunk element 48 formed in the header plate 18 by pressing, and surrounding the corresponding aperture 44. The countersunk elements 48 are concave upwards, i.e. towards the header space 28, so that the retaining head 46 of each immobilising pin 42 is inserted from the side of the header plate corresponding to the interior of the header.

Each of the immobilising elements 42 also has an extension projecting from its head 46 and comprising a shank 50, which engages against the longitudinal sides of a group of several fins, as can be seen in FIG. 3. The respective shanks 50 of the pins 42 extend parallel to the direction of the tubes 12 in the bundle, and lie on either side of the single row of tubes, which is centered on a mid plane R (FIG. 4). It is then merely necessary to provide at least two immobilising elements 42, 42 each adapted to abut on a side face 52 of the tube bundle, and at least two further immobilising elements 42 adapted to abut on an opposite side face 54 of the tube bundle (see FIG. 4). The faces 52 and 54 are each defined by longitudinal edges of the fins in the group mentioned above.

As can be seen in FIG. 3, the sealing gasket 30 which overlies the header plate 18 also overlies the respective heads 46 of the immobilising pins 42. This guarantees sealing where the pins 42 pass through the apertures 44. Also as can be seen in FIG. 3, the shank 50 of each element 42 includes a flat 56 which defines a retaining shoulder for the group of fins mentioned above, and this also enables a pre-determined spacing to be maintained between the first fin of the bundle and the header plate 18.

The heat exchanger shown in FIGS. 3 and 4 also includes abutment members 58 depending from the header casing 26 and formed integrally with the latter. Each abutment element 58 terminates in a base 60 which acts as an abutment against translational movement by bearing against a head 46 of a corresponding one of the immobilising pins 42, the gasket 30 being interposed. In this way, any accidental shifting of the pins 42 is prevented.

Figure 5:
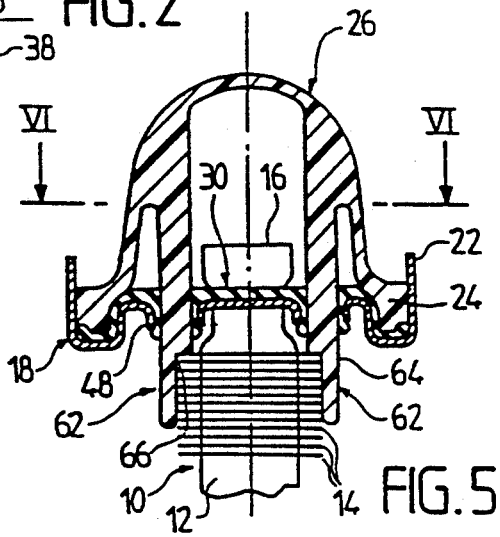
FIG. 5 is a view in transverse cross section taken on the line V—V in FIG. 6, showing part of a heat exchanger in a modified embodiment.
Figure 6:
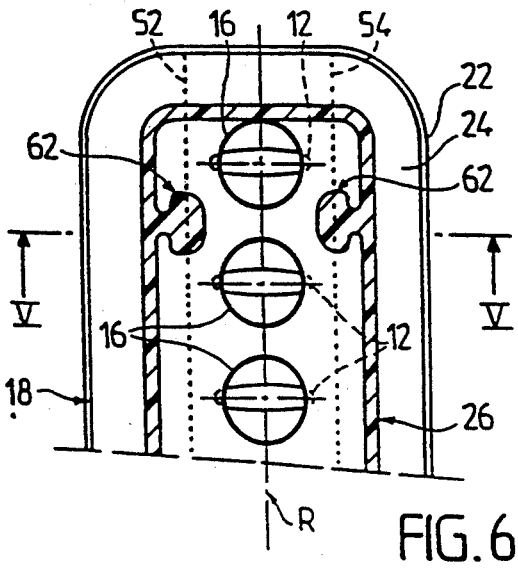
FIG. 6 is a view in cross section taken on the line VI—VI in FIG. 5, showing part of the same heat exchanger.

Reference is now made to FIGS. 5 and 6, which show a modification of the arrangement shown in FIGS. 3 and 4. In FIGS. 5 and 6, the heat exchanger again includes the immobilising elements, 62, which perform the same function as the elements 42 in FIGS. 3 and 4. However, in this embodiment the elements 62 depend from the header casing 26 itself, and are formed integrally with it, for example by moulding in a suitable plastics material. These elements 62 extend, like the pins 42 in FIG. 3, in a direction parallel to the longitudinal direction of the tubes defined by the plane R. They again pass through the apertures 44 in the header plate 18, and have respective extensions 64 which extend beyond the header plate. Each extension 64 is formed with a flat 66 defining a retaining shoulder for a group of fins situated adjacent to the header plate 18. It should be noted that each of these elements 62 passes sealingly through the gasket 30, the latter being compressed between each element 62 and the corresponding countersunk element 48.

In the various embodiments described above, a rigid connection is made between the tube bundle and the header that consists of the header plate and header casing assembled together, without any need to provide any special or modified design of fins.

The invention is suitable most particularly for heat exchangers for motor vehicles, that is to say engine cooling radiators or cabin heating radiators.

What is claimed is:

1. A heat exchanger comprising a bundle of tubes, each with an end portion; fins carried by the said tubes; and a header comprising a header casing having an open side and a header plate closing the said open side to define an enclosed header space between them, the header plate being formed with holes, the said end portions of the tubes being sealingly fitted in the said holes; and further including at least one immobilising element extending through the header plate and beyond the latter on the opposite side thereof from the header casing, in a direction parallel to the longitudinal direction of the tubes, the header plate having at least one through aperture with each said immobilising element passing through a said aperture, and the heat exchanger further including means sealing the said at least one aperture from the header space, each immobilising element including an extension, the fins including a group of several fins adjacent to the header plate with said group defining opposed longitudinal sides of the group of fins, and with the said extensions of the immobilising elements bearing on the said longitudinal sides, whereby to constitute immobilising means for opposing any relative displacement of the tube bundle with respect to the header plate.

2. A heat exchanger according to claim 1, wherein the header plate is formed with a plurality of said apertures each defining a countersunk element around the aperture, with each immobilising element having a retaining head engaged in a corresponding one of the said countersunk elements, the said extension of each immobilising element being an extension of its head.

3. A heat exchanger according to claim 2, further including a sealing gasket overlying the header plate and the heads of the immobilising elements.

4. A heat exchanger according to claim 2, further including abutment elements depending from the header casing, with each abutment element abutting on a said immobilising element so as to prevent accidental shifting of the latter.

5. A heat exchanger according to claim 1, wherein each immobilising element is integral with the header casing and depends from it.

6. A heat exchanger according to claim 5, further including a sealing gasket overlying the header plate, with each immobilising element passing sealingly through the sealing gasket.

7. A heat exchanger according to claim 1, wherein the said extension of each immobilising element is formed with a flat defining a retaining shoulder for engagement against a group of the said fins.

* * * * *